US006065520A

United States Patent [19]

Lee et al.

[11] Patent Number: 6,065,520

[45] Date of Patent: May 23, 2000

[54] TAPE HOLDER

[76] Inventors: Luke Hao Lee; Richard Lee, both of 7 F., No. 152-1, Sec. 7, Chung-Shan N. Rd., Taipei, Taiwan

[21] Appl. No.: 08/971,551

[22] Filed: Nov. 17, 1997

[51] Int. Cl.[7] ..... B32B 31/00

[52] U.S. Cl. ..... 156/530; 156/579; 156/289; 156/580; 156/270; 156/269; 156/302; 156/552

[58] Field of Search ..... 156/530, 579, 156/511, 289, 580, 537, 269, 270, 302, 552; 53/582, 419, 139.1

[56] References Cited

U.S. PATENT DOCUMENTS

| | | | |
|---|---|---|---|
| 3,221,468 | 12/1965 | Casey | 53/417 |
| 3,555,764 | 1/1971 | Dowling | 53/412 |
| 4,227,955 | 10/1980 | Woods et al. | 156/269 |
| 4,545,185 | 10/1985 | Chikatani | 53/583 |
| 5,118,381 | 6/1992 | Ryder et al. | 156/552 |

*Primary Examiner*—Richard Crispino
*Assistant Examiner*—Linda L. Gray
*Attorney, Agent, or Firm*—A & J

[57] ABSTRACT

A tape holder that dispenses tape sections with non-sticky or adhered portions at both ends, includes a base, a feed device disposed at a tape exit of the base, a side cutter gate disposed at one side of the feed device, and an auxiliary tape support connected to the feed device. The base has a tape receiving recess for receiving a large adhesive tape reel and a small substrate tape reel such that the adhesive side of the adhesive tape faces the substrate tape below. Both tapes may be pulled at at the same time and placed at the feed device where a portion of the tapes are pressed to form adhered portions. The side cutter gate has a cutting edge that cuts the substrate tape below or both tapes at the same time. After a desirable length of the adhesive tape has been pulled out, another adhered portion can be formed at the other end of the length. The auxiliary tape support is provided with serrations and may be connected to the front side of the base where the feed device is located to cut the tape as ordinary tape holders.

1 Claim, 5 Drawing Sheets

TAPE HOLDER

BACKGROUND OF THE INVENTION

1. Field of the Invention

The present invention relates generally to a tape holder, and more particularly to a tape holder adapted to dispense tape sections with non-sticky or adhered end portions to facilitate removal thereof from where they are applied.

2. Description of the Prior Art

Adhesive tapes are not sticky to the hand and can be conveniently used in wrapping. However, once they are adhered to the wrappings, cartons, paper cardboards, etc., they are difficult to tear off due to their sticky properties. It is desirable to have tapes that have non-sticky portions at both ends of tape sections to facilitate removal thereof in a convenient and fast way. FIG. 1 shows tapes sections 1 having non-sticky portions 1A and 1B on a wrapping 2. The non-sticky portions tilt outwardly slightly.

To form such tapes 1, a small portion at either end of the tape section 1 has to be folded to form the non-sticky portion when the tape is dispensed using a tape holder. Or small pieces of paper, etc., are used to stick to the end portions of the tape section 1. These methods of forming the non-sticky end portions cannot be carried out using the tape holder and have to performed manually, which is very inconvenient and slow.

SUMMARY OF THE INVENTION

The present invention relates generally to a tape holder, and more particularly to a tape holder adapted to dispense tape sections with non-sticky or adhered end portions to facilitate removal thereof from where they are applied.

According to a first aspect of the present invention, non-sticky or adhered portions are formed with the dispensing of the tape from the tape holder. The tape holder of the invention includes an adhesive tape reel and a substrate tape reel disposed in a tape receiving recess of a base, with the substrate tape placed at a lower end of the adhesive tape such that the adhesive side of the adhesive tape faces the substrate tape below. A specially designed feed device is disposed at a tape exit where the two tapes are held to form adhered portions. A side cutter gate is also provided to cut the substrate tape or both tapes at the same time.

According to a second aspect of the present invention, an auxiliary tape support is provided for cutting the adhesive tape like ordinary tape holders.

According to a third aspect of the present invention, the substrate tape may be an adhesive tape such that its adhesive side faces the adhesive tape above. When the adhesive tape above has been used up, the adhesive tape below can serve as a replacement.

DETAILED DESCRIPTION OF THE PREFERRED EMBODIMENT

Figure 3J:
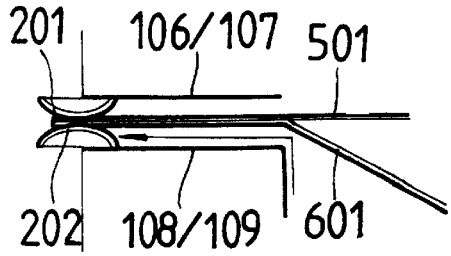
FIGS. 3A–3J are schematic views illustrating operation of the tape holder of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
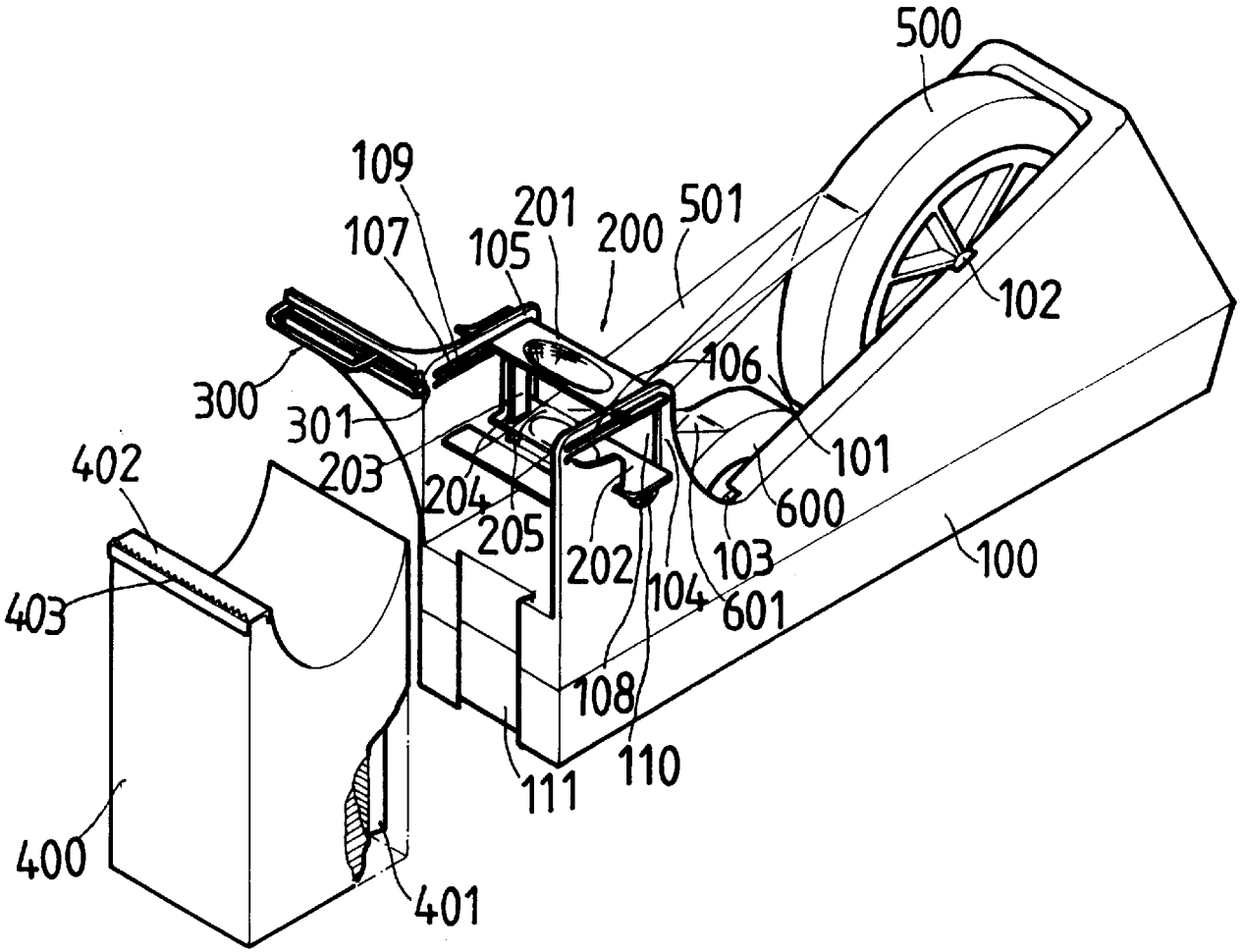
FIG. 2 is a perspective view of the tape holder of the present invention.

As can be seen in FIG. 2, the tape holder of the present invention essentially comprises a base 100, a feed device 200 at an exit of the base 100, a side cutter gate 300 at one side of the feed device 200, and an auxiliary tape support 400 connected to the feed device 200. The base 100 has a tape receiving recess 101, one side wall of which is provided with mounting slots 102, 103 for supporting a large adhesive tape reel 500 and a small substrate tape reel 600 such that the latter is placed at a lower end of the former and such that the adhesive side of the tape 501 faces the tape 601 of the substrate tape reel 600. At the point where the tapes 501 and 601 meet, i.e., the tape exit, the feed device 200 is arranged for joining the tapes together to form an adhered portion. The feed device 200 is made of smooth material and includes a finger press top plate 201 and a finger press bottom plate 202 fitted together. That side of the top plate 201 which faces the bottom plate 202 has a vertically oriented slide rod 203 at an offset position. Relative to the position of the slide rod 203, the bottom plate 202 is provided with a through hole 204 for receiving the slide rod 203. The slide rod 203 penetrates through the through hole 204 such that its rear end forms a stop block 205 of a larger plate surface. The stop block 205 urges against the bottom plate 202 so that the latter may slide near or away from the top plate 201 without slippage. On the two side walls 104, 105 at the tape exit of the base 100 there are provided planar track slots 106, 107 corresponding to the two ends of the top plate 201 such that the ends of the top plate 201 respectively extend through the track slots 106, 107 and the top plate 201 may displace forwardly or rearwardly along the track slots 106, 107. On the side walls 104, 105 near the lower ends of the track slots 106, 107, there are provided inverted L-shaped through grooves 108, 109 with a depth of about the thickness of two layers of tape such that the two ends of the bottom plate 202 may extend therethrough. The lower portion of the horizontal section of one of the through track grooves is enlarged such that its width can receive a single finger. A finger hole 110 is further provided at the lower end of the vertical section of the same through track groove. By means of the above-described arrangement, the user may place the tapes 501, 601 on the bottom plate 202 with one index finger pressing the top plate while the thumb passes through the finger hole 110 to touch a bottom side of the bottom plate 202. With both fingers pressing the top plate 201 and the bottom plate from above and below, the tapes 501, 601 sandwiched between the top plate 201 and the bottom plate 202 stick together to form an adhered portion ready to be pulled out by the user using the other hand. The pulled out portions of the tapes 501, 601 are pushed sideways to the exit via the side cutter gate 300 such that a cutting edge 301 of the side cutter gate 300 is held between the tapes 501, 601. The cutting edge 301 may cut the tape 601 or both tapes 501, 601 to obtain an adhesive tape with non-sticky portions. A front side of the base 100 is further provided with a receiving portion 111, whereas a rear side of the auxiliary tape support 400 is provided with a corresponding engaging portion 401 such that the auxiliary tape support 400 may be coupled to the front side of the base 100. The auxiliary tape support 400 further has a metal plate 402 at a front side thereof. A front edge of the metal plate 402 projects upwardly to form serrations 403. After the auxiliary tape support 400 is coupled to the base 100, the metal plate 402 can be used to cut the tape 501 of the large tape reel 500.

Figure 3A:
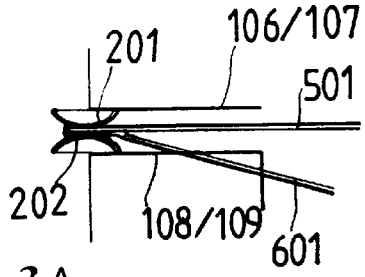
Figure 3B:
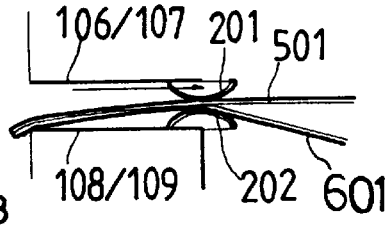
Figure 3C:
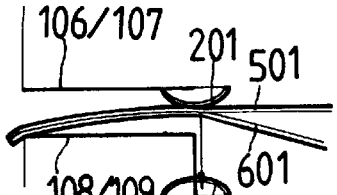
Figure 3D:
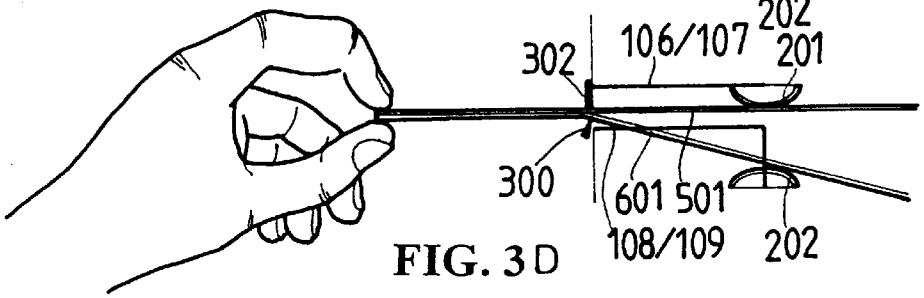
Figure 3E:
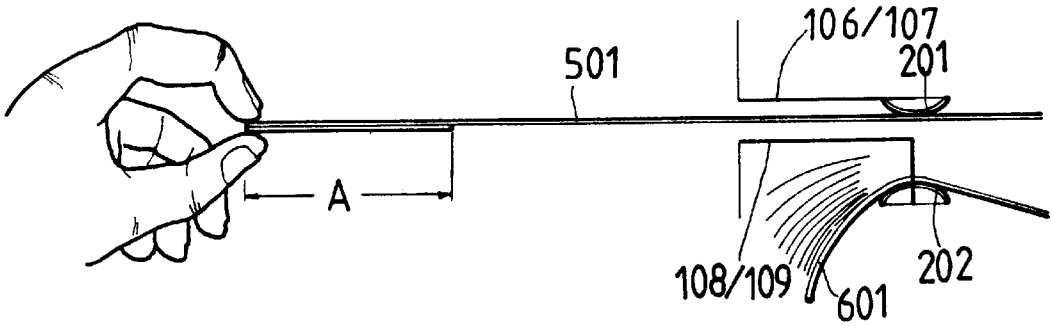
Figure 3F:
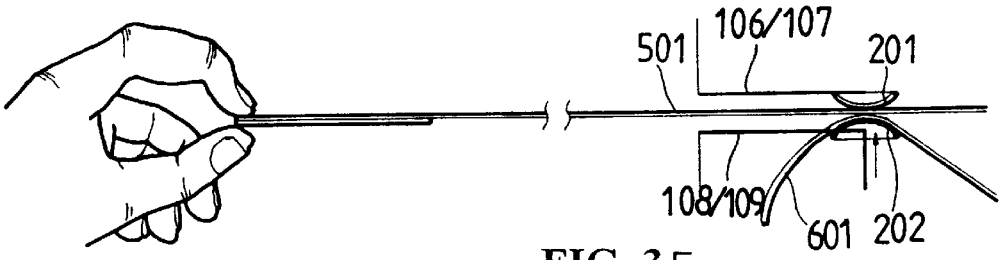
Figure 3G:
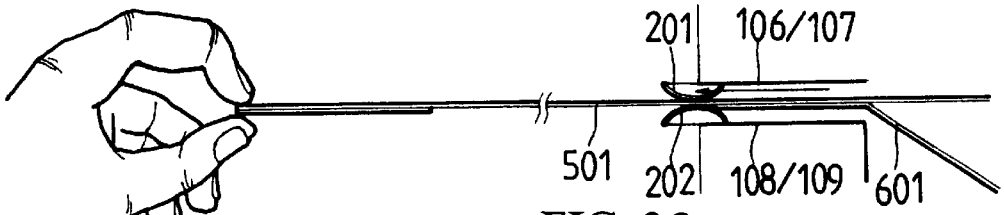
Figure 3H:
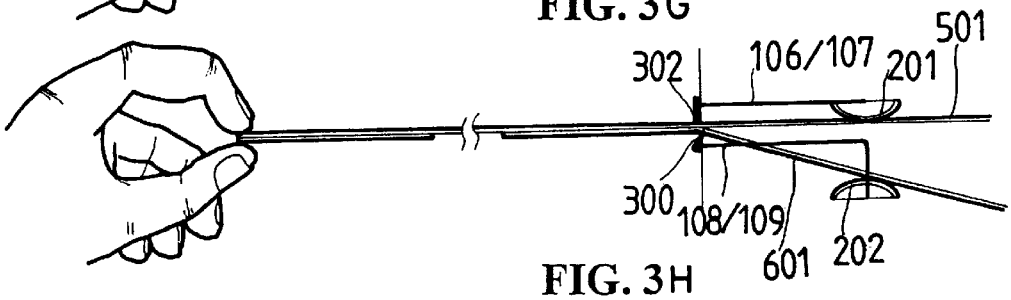
Figure 3I:
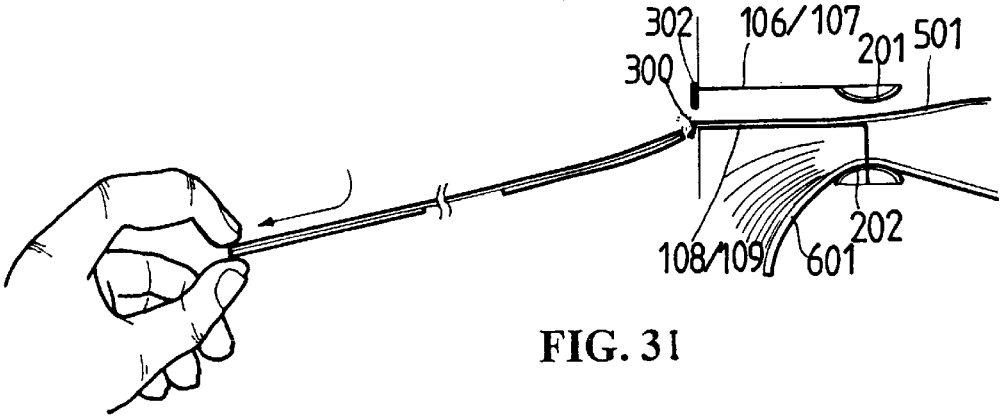

FIGS. 3A–3J illustrate use of the present invention. In FIG. 3A, two fingers are used to place the top plate 201 and bottom plate 202 at the front ends of the track slots 106, 107 and through track grooves 108, 109 to press the tapes 501, 601 together. In FIG. 3B, the top plate 201 and bottom plate 202 are moved towards the rear ends of the track slots 106, 107 and through slot grooves 108, 109 so as to cause the tapes 501, 601 to form an adhered portion. As a general rule, the user will release the fingers once the adhered portion is formed. At this point, referring to FIG. 3C, the bottom plate 202 will drop, releasing its pressure on the tapes 501, 601, the user may then proceed to the step in FIG. 3D, in which the user holds the adhered portion and pulls it out with one hand and uses the other hand to push the side cutter gate 300 to the exit where the tapes 501, 601 are such that the the cutting edge 301 orienting towards the exit comes in between the tapes 501, 601 and a flange 302 of the side cutter gate 300 urges against the tape 501 above. Since the point of the side cutter gate 300 inclines inwardly and the distance between the flange 302 and the point may just allow passage of two layers of tape, when the tapes 501, 601 are pulled out, the point may gradually cut the tape 601 from below at the point where it is not adhered to the tape 501 above to form the adhered portion A shown in FIG. 3E, which facilitates holding of the adhesive tape or removal thereof from where it is applied. The tape 601 therefore drops and rests on the bottom plate 202. After a certain section of the tape 501 has been pulled out and it is desirable to form another adhered portion at the end of the section of tape, the user again presses the top plate 201 and the bottom plate 202 with two fingers so that the tapes 501, 601 stick together at one point, as shown in FIG. 3F. Then in the step shown in FIG. 3G, the top plate 201 and bottom plate 202 are moved towards the front ends of the track slots 106, 107 and the through track grooves 108, 109 and then to the rear ends, as shown in FIG. 3H. The tapes 501, 601 are then pulled out, and the side cutter gate 300 are moved in between the tapes 501, 601. After a certain length of the tapes 501, 601 are pulled out, referring to FIG. 3I, the tapes are pressed downwardly so that they are simultaneously cut by the point of the side cutter gate 300 to obtain a section of tape 501 with an adhered portion at each end. Then, as shown in FIG. 3J, the top plate 201 and bottom plate 202 are held together and moved towards the front ends of the track slots 106, 107 and the through track grooves 108, 109 to hold the tapes 501, 601 between the top and bottom plates, ready for the next operation.

Figure 4:
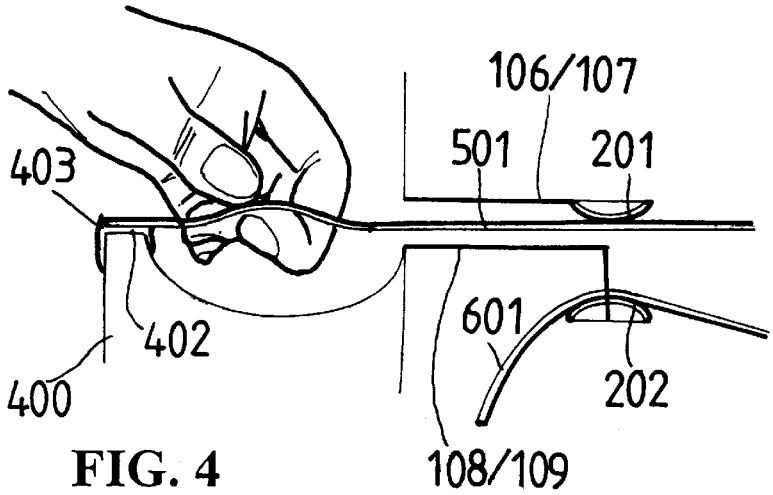
FIG. 4 is a schematic view of another embodiment of the tape holder of the present invention.
Figure 1:
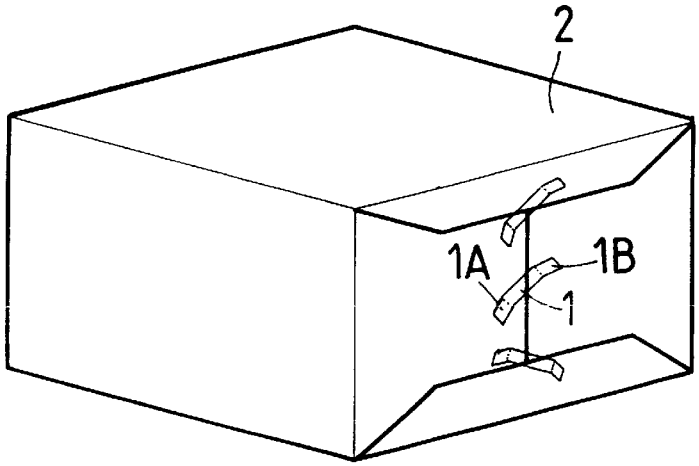
PRIOR ART FIG. 1
FIG. 1 is a schematic view illustrating use of tapes with convenient tear-off non-sticky portions at both ends.

The present invention may also be used in the way shown in FIG. 4, in which the tape 501 is directly cut using the serrations 403 of the metal plate 402 of the auxiliary tape support 400, like ordinary tape holders.

Figure 5:
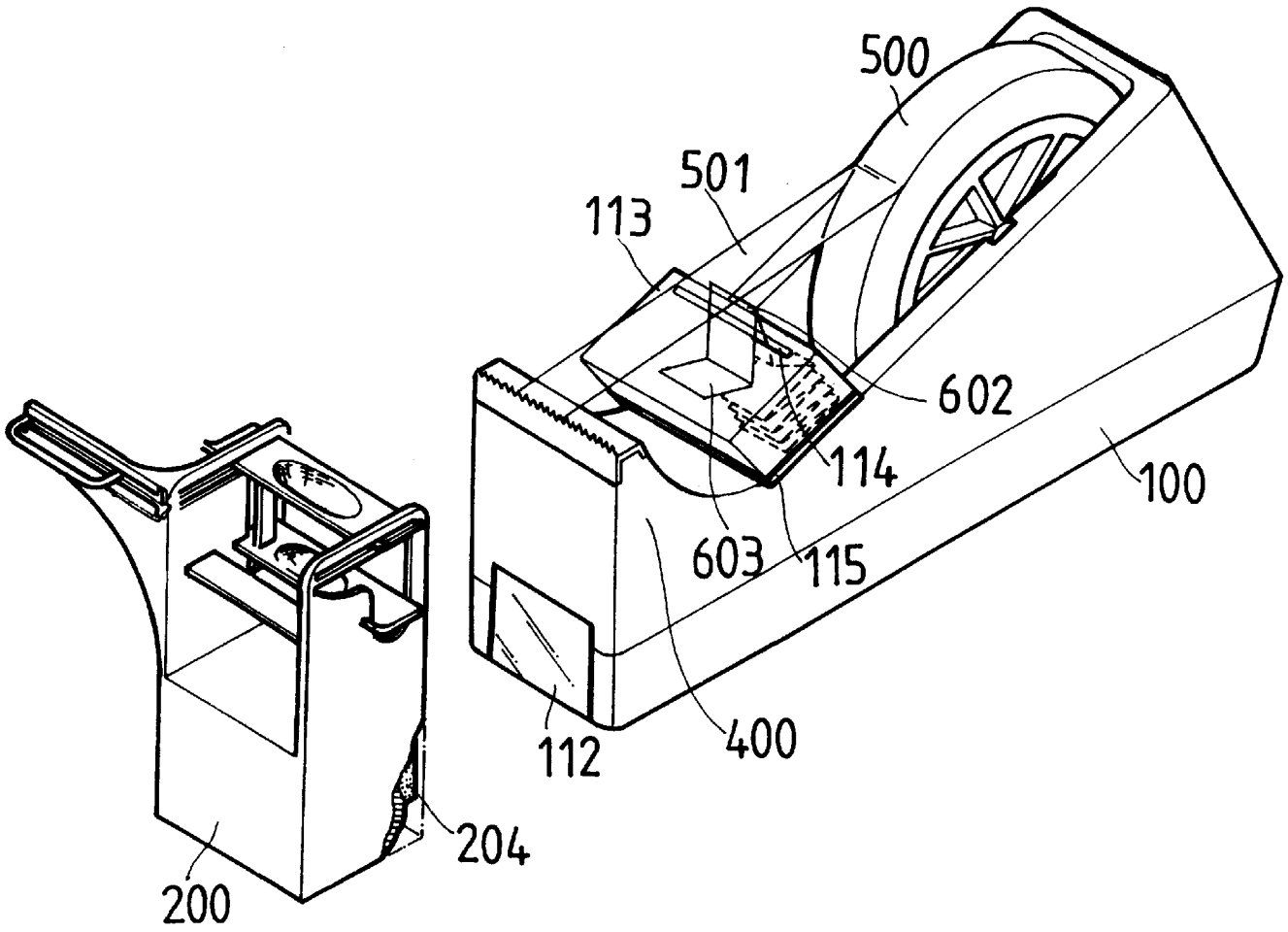
FIG. 5 is a schematic view of still another embodiment of the tape holder of the present invention.

FIG. 5 illustrates another preferred embodiment of the present invention, in which the auxiliary tape support 400 and the base 100 are integrally formed while the feed device 200 is a separate unit connectable to the front end of the base 100 by suitable means. In the embodiment shown in FIG. 5, the front end of the base 100 is provided with an iron plate 112 while the feed device 200 is provided with a magnet 204. Furthermore, a substrate tape 602 may be folded and stored inside a case 113. The case 113 is provided with an adhesive layer 115 at its bottom end for adhering the case 113 to the side wall edges at the upper end of the tape receiving recess 101. A slit 114 is formed at an upper side of the case 113 to allow passage of a tape 603 of the substrate tape 602 therethrough to form an adhered portion with the adhesive tape 501.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A tape holder, comprising:

a base having a tape receiving recess and a tape exit at a front end thereof;

a feed device disposed at said tape exit of said base;

a side cutter gate disposed at one side of said feed device and including a cutting edge; and an auxiliary tape support connected to said front end of said base, wherein said tape receiving recess of said base has one side wall thereof provided with mounting slots for receiving a larger adhesive tape reel and a smaller substrate tape reel such that said substrate tape reel is disposed at a lower end of said adhesive tape reel and the adhesive side of said adhesive tape faces the substrate tape; the adhesive tape and substrate tape are adhered at said tape exit by means of said feed device to form an adhered portion, said cutter gate being moved such that said cutting edge thereof comes in between the adhesive tape and the substrate tape to cut the substrate tape or both the adhesive tape and the substrate tape to obtain a section of an adhesive tape with adhered portions at both ends to facilitate holding and removal thereof; said feed device is made of smooth material and includes a finger press top plate and a finger press bottom plate, said top plate having a slide rod disposed at an offset position at a bottom side thereof, said slide rod projecting in the direction of said bottom plate, said bottom plate being provided with a through hole corresponding to said slide rod such that said slide rod passes through said through hole to form a atop block of a larger plate surface for urging against said bottom plate to slide substantially vertically along said slide rod towards or away from said top plate without slippage; and side walls at said tape exit of said base are provided with planar track slots through which both ends of said top plate extends and along which said bottom plate slides forwardly or rearwardly, said side walls further having inverted L-shaped through track grooves disposed below said track slots, said through track grooves having a depth of about the thickness of the adhesive tape and substrate tape, said bottom plate having its two ends extending through said through track grooves, the horizontal portion of one of said through track grooves being enlarged to the width of a human finger, while a finger hole is provided below the vertical portion of the corresponding through track groove.

* * * * *